US010699602B2

(12) United States Patent
Frost

(10) Patent No.: US 10,699,602 B2
(45) **Date of Patent: *Jun. 30, 2020**

(54) CORRUGATED SIGNAGE

(71) Applicant: Vanguard Packaging, LLC, Kansas City, MO (US)

(72) Inventor: Jerry Ryan Frost, Kansas City, MO (US)

(73) Assignee: Vanguard Packaging, LLC, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/952,928

(22) Filed: Apr. 13, 2018

(65) Prior Publication Data

US 2018/0233070 A1 Aug. 16, 2018

Related U.S. Application Data

(63) Continuation of application No. 14/679,586, filed on Apr. 6, 2015, now Pat. No. 9,947,245, which is a (Continued)

(51) Int. Cl.
*G09F 1/06* (2006.01)
*G09F 15/00* (2006.01)
(Continued)

(52) U.S. Cl.
CPC ..... *G09F 1/06* (2013.01); *B31D 5/02* (2013.01); *B31D 5/04* (2013.01); *G09F 15/00* (2013.01); *G09F 15/0062* (2013.01)

(58) Field of Classification Search
None
See application file for complete search history.

(56) References Cited

U.S. PATENT DOCUMENTS 2,115,293 A 4/1938 Rusling
2,578,060 A 12/1951 Grant
(Continued)

FOREIGN PATENT DOCUMENTS

CA 2693596 A1 1/2009
DE 3824930 A1 1/1990
GB 1188834 A 4/1970

OTHER PUBLICATIONS

"Final Rejection Received for U.S. Appl. No. 14/679,586 dated Apr. 6, 2017" 12 pages.

(Continued)

*Primary Examiner* — Kristina N Junge
(74) *Attorney, Agent, or Firm* — Kutak Rock LLP

(57) ABSTRACT

A corrugated display sign with a former panel secured to a backer panel. The former panel includes a central section opposed by two lateral sections, two support members partially cut away from the central section and maintaining a connection with the central section via at least one fold line, and two or more preformed slots, with one slot positioned adjacent to the support members. The display sign further includes a graphic panel operable to be wrapped around exterior edges of the lateral sections, and having ends secured to the backer panel. The display sign is capable of being erected from a knockdown configuration to an erected configuration by folding the lateral sections away from the central section and wrapping the graphic panel about the lateral sections.

20 Claims, 7 Drawing Sheets

Related U.S. Application Data continuation of application No. 13/955,811, filed on Jul. 31, 2013, now Pat. No. 8,997,388.

(60) Provisional application No. 61/677,937, filed on Jul. 31, 2012.

(51) Int. Cl.
*B31D 5/02* (2017.01)
*B31D 5/04* (2017.01)

(56) References Cited

U.S. PATENT DOCUMENTS

| | | | |
|---|---|---|---|
| 2,918,178 | A | 12/1959 | Leone |
| 3,195,798 | A | 7/1965 | Wilson |
| 3,362,610 | A | 1/1968 | Dyke |
| 3,987,737 | A | 10/1976 | Smith |
| 4,143,763 | A | 3/1979 | Haglund |
| 4,306,675 | A | 12/1981 | Swanson |
| 4,341,338 | A | 7/1982 | Arnold |
| 4,383,636 | A | 5/1983 | Chaffers |
| 4,427,108 | A | 1/1984 | Coles et al. |
| 4,458,838 | A | 7/1984 | Lacasa et al. |
| 4,506,790 | A | 3/1985 | Muscari |
| 4,567,996 | A | 2/1986 | Muise |
| 4,646,922 | A | 3/1987 | Smith |
| 4,871,067 | A | 10/1989 | Valenti |
| 4,889,252 | A | 12/1989 | Rockom |
| 4,932,533 | A | 6/1990 | Collier |
| 5,016,545 | A | 5/1991 | Robertson et al. |
| 5,145,244 | A | 9/1992 | Kersting et al. |
| 5,190,211 | A | 3/1993 | Stoddard et al. |
| 5,193,466 | A | 3/1993 | Eder |
| 5,213,220 | A | 5/1993 | McBride |
| 5,226,571 | A | 7/1993 | Eastwood et al. |
| 5,253,769 | A | 10/1993 | Vlastakis |
| 5,277,360 | A | 1/1994 | Demott |
| 5,301,800 | A | 4/1994 | Kenney |
| 5,312,034 | A | 5/1994 | Nakagawa et al. |
| 5,316,210 | A | 5/1994 | Scullin |
| D348,000 | S | 6/1994 | Strasevicz et al. |
| 5,318,789 | A | 6/1994 | Nakagawa et al. |
| 5,322,212 | A | 6/1994 | Strasevicz |
| 5,333,777 | A | 8/1994 | Roth |
| D352,235 | S | 11/1994 | Strasevicz et al. |
| 5,579,991 | A | 12/1996 | Strasevicz et al. |
| 5,702,011 | A | 12/1997 | Carroll |
| 5,706,959 | A | 1/1998 | Smith |
| 5,826,732 | A | 10/1998 | Ragsdale |
| 5,966,857 | A | 10/1999 | Pettersson et al. |
| 6,068,140 | A | 5/2000 | Mangrum et al. |
| 6,126,254 | A | 10/2000 | Maglione |
| 6,168,073 | B1 | 1/2001 | Towle |
| 6,347,772 | B1 | 2/2002 | L'Hotel |
| 6,378,710 | B1 | 4/2002 | Grueneberg |
| 6,508,023 | B2 | 1/2003 | Moss et al. |
| 6,612,669 | B2 | 9/2003 | Grueneberg |
| 6,715,623 | B2 | 4/2004 | Broerman |
| 7,007,615 | B2 | 3/2006 | Grueneberg |
| 7,066,342 | B2 | 6/2006 | Baechle et al. |
| 7,111,735 | B2 | 9/2006 | Lowry |
| 7,137,517 | B2 | 11/2006 | Lowry et al. |
| 7,252,200 | B1 | 8/2007 | Hester |
| 7,281,648 | B2 | 10/2007 | Lowry |
| 7,546,927 | B2 | 6/2009 | Lowry et al. |
| 7,634,865 | B2 | 12/2009 | L'Hôtel |
| 7,677,433 | B2 | 3/2010 | Little |
| 7,703,864 | B2 | 4/2010 | Moser |
| 7,810,707 | B2 | 10/2010 | Little |
| 7,819,305 | B2 | 10/2010 | Little |
| 7,861,916 | B2 | 1/2011 | Little |
| 7,981,017 | B2 | 7/2011 | Little |
| 8,596,518 | B2 | 12/2013 | Babcock |
| 8,997,388 | B1 | 4/2015 | Frost |
| 9,947,245 | B1 | 4/2018 | Frost |
| 2002/0108541 | A1 | 8/2002 | Grueneberg |
| 2003/0160015 | A1 | 8/2003 | Broerman |
| 2005/0067321 | A1 | 3/2005 | Pitts et al. |
| 2008/0030113 | A1 | 2/2008 | Vail |
| 2008/0083682 | A1 | 4/2008 | Moss et al. |
| 2008/0169340 | A1 | 7/2008 | Sheffer |
| 2009/0119956 | A1 | 5/2009 | Martin Presa |
| 2009/0286663 | A1 | 11/2009 | Little et al. |
| 2010/0083618 | A1 | 4/2010 | Little |
| 2010/0087304 | A1 | 4/2010 | Little |
| 2010/0234201 | A1 | 9/2010 | Little et al. |
| 2010/0236117 | A1 | 9/2010 | Mestres et al. |
| 2011/0011922 | A1 | 1/2011 | Little |
| 2011/0088300 | A1 | 4/2011 | Martin Presa |
| 2012/0012734 | A1 | 1/2012 | Tzuo |
| 2013/0192110 | A1 | 8/2013 | Da Fonseca et al. |
| 2013/0213915 | A1 | 8/2013 | Pfeifer et al. |

OTHER PUBLICATIONS

"Non-Final office action received for U.S. Appl. No. 13/955,811 dated Jul. 9, 2014" 9 pages.

"Non-Final office action received for U.S. Appl. No. 14/679,586 dated Aug. 19, 2016" 16 pages.

"Notice of Allowance received for U.S. Appl. No. 13/955,811 dated Dec. 3, 2014" 10 pages.

"Notice of Allowance received for U.S. Appl. No. 14/679,586 dated Dec. 13, 2017" 13 pages.

CORRUGATED SIGNAGE

RELATED APPLICATIONS

The present patent application is a continuation application of co-pending U.S. patent application Ser. No. 14/679,586 filed Apr. 6, 2015, which is a continuation of U.S. patent application Ser. No. 13/955,811, filed Jul. 31, 2013, now U.S. Pat. No. 8,997,388, which claims priority benefit, with regard to all common subject matter, of earlier-filed U.S. Provisional Patent Application No. 61/677,937, filed Jul. 31, 2012, and entitled "FACETED CORRUGATED SIGNAGE." The identified earlier-filed patent applications are hereby incorporated herein by reference.

FIELD

Embodiments of the present invention relate generally to the field of point of purchase merchandise displays. More particularly, embodiments of the present invention relate to a corrugated, paperboard sign that is manufactured in a fold and glue assembly process and that is traditionally provided to an end user in a collapsed or knockdown configuration for setup.

BACKGROUND

Corrugated signs and containers are often made from pieces of flat paperboard stock material that are die cut into shapes that define various panels. The shapes are folded along predefined lines between the panels with overlapping sides, strips, or panels that are glued, taped or otherwise affixed to another panel to form an enclosed boundary. The panels are folded and/or glued into place to become the walls of the sign or container. The signs and/or containers are traditionally provided to product manufacturers and/or retailers in a collapsed or knockdown configuration for storage, handling and shipping. The manufacturer and/or retailers open the knockdown signs or containers and fold them appropriately to erect the assembled sign or container for display.

The corrugated sign or containers are typically manufactured by feeding flat die cut sheets through a fold-and-glue machine. The fold-and-glue machine applies adhesive and folds over select panels so that the panels are in the knockdown configuration. Signs associated with corrugated display containers, as well as corrugated and/or plastic signage in general, are traditionally made from flats pieces of corrugated or plastic material. Such signs are one-dimensional and often relatively unimpressive. Therefore, it would be beneficial to provide a corrugated paperboard signage assembly that is three-dimensional and that transforms quickly and easily from a knockdown to an erected configuration.

SUMMARY

Embodiments of the present invention include a corrugated display sign with a former panel secured to a backer panel. The former panel includes a central section opposed by two lateral sections, two support members partially cut away from the central section and maintaining a connection with the central section fold lines, and two or more preformed slots, with at least one of the slots positioned adjacent to each of the support members. The display sign further includes a graphic panel operable to be wrapped about exterior edges of the lateral sections, and having ends secured to the backer panel.

Embodiments of the present invention further include a method for making a corrugated sign including: forming a backer panel; forming a former panel; joining the former panel with the backer panel; compressing the former panel to create fold lines, such that the former panel presents a central section opposed by two lateral sections; cutting the central section of the former panel to present two support members, with the support members operable to be folded away from the former panel; cutting one or more slots in the lateral sections, with at least one of the slots positioned adjacent to each side of each of the support members; wrapping a graphic panel about exterior edges of the lateral sections; and securing ends of the graphic panel to the backer panel.

Embodiments of the present invention further include a method for erecting a corrugated sign. Steps of the method include providing the corrugated display sign in a knockdown configuration, with the corrugated display sign having: a former panel secured to a backer panel. The former panel includes: a central section opposed by two lateral sections; two support members partially cut away from the central section and maintaining a connection with the central section via fold lines; and two or more preformed slots, with at least one of the slots positioned adjacent to each of the support members. The steps further include: folding the support members away from the central section; folding the lateral sections away from the central section until they abut the support members; wrapping a graphic panel about exterior edges of the lateral sections; and securing ends of the graphic panel to the backer panel.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
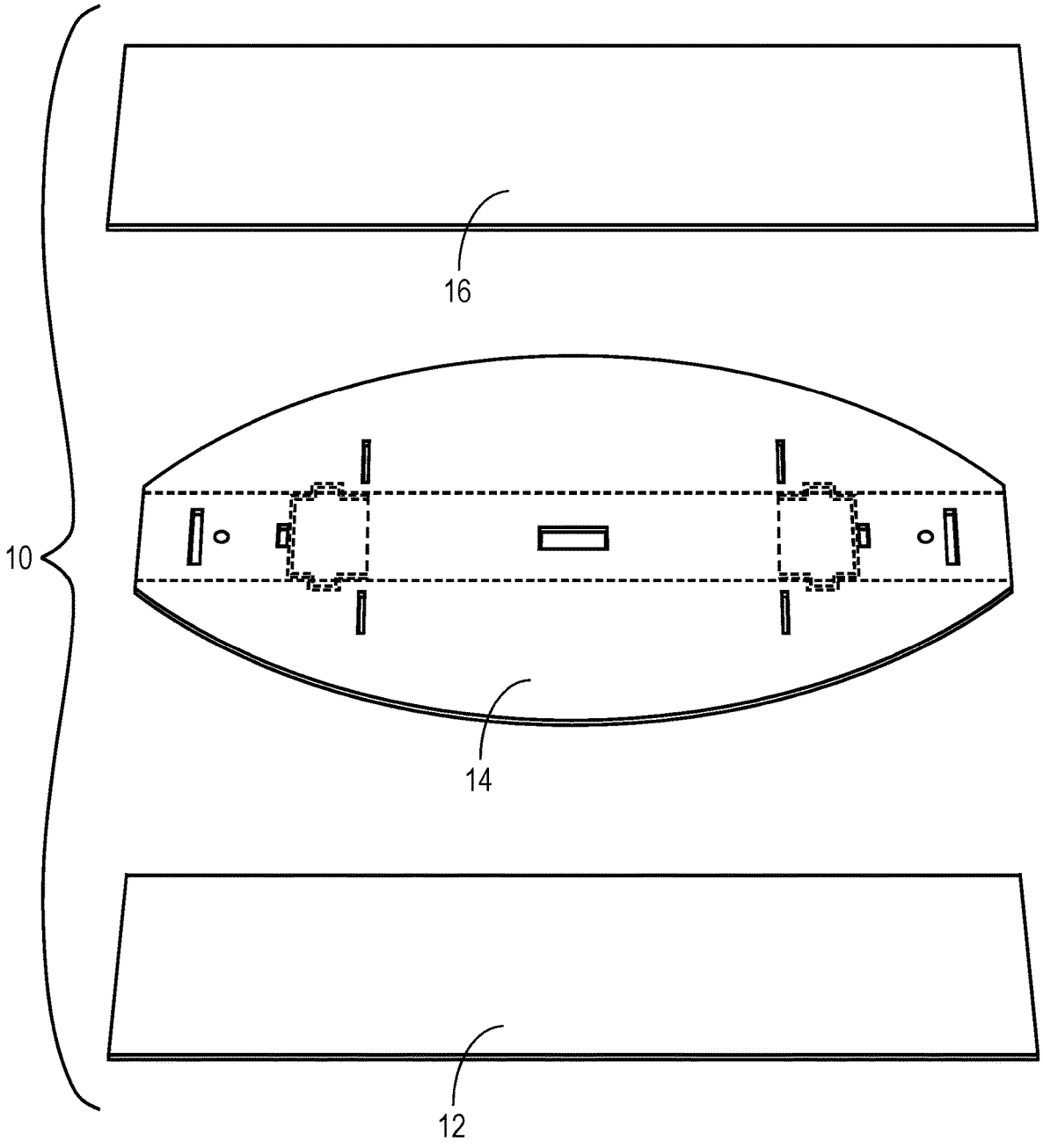
FIG. 1 is an exploded view of a signage assembly of embodiments of the present invention, with the signage assembly including a backer panel, a former panel, and a front graphic panel.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

As used herein, the term "longitudinal" generally refers to an orientation or direction relative to an axis of elongation, whereas the term "lateral" refers to an orientation or direction that is generally perpendicular to the axis of elongation.

Figure 2:
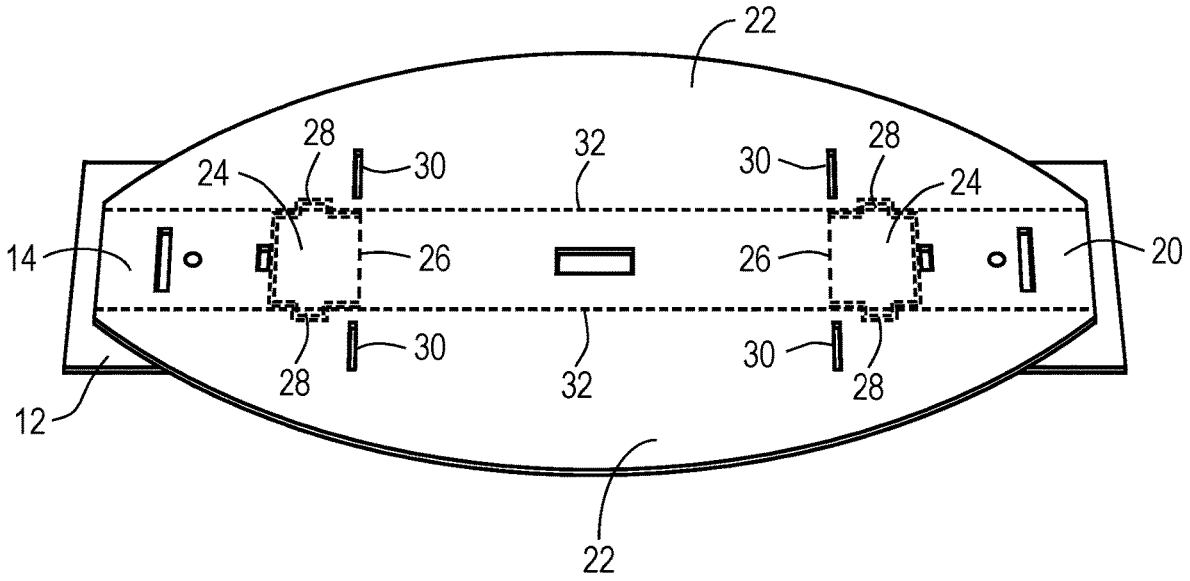
FIG. 2 is a perspective view of the former panel and the backer panel from the signage assembly of FIG. 1 secured together in a knockdown configuration.
Figure 5:
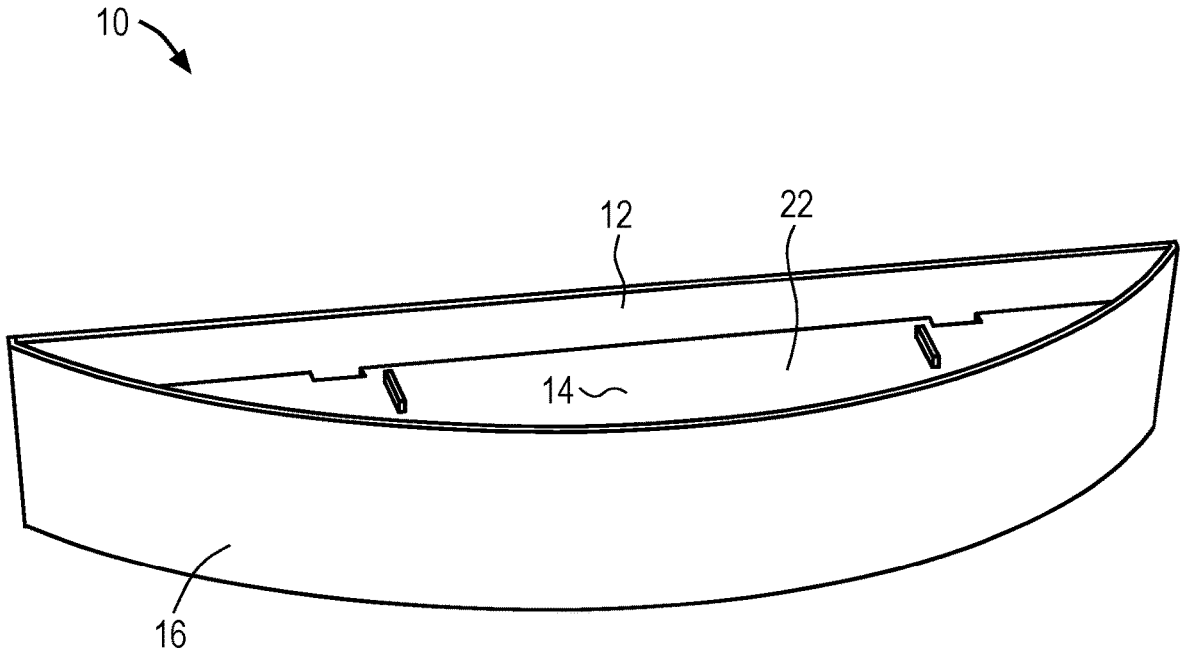
FIG. 5 is a perspective view of the former panel and the backer panel from FIGS. 1-4 in an erected configuration, and with the front graphic panel secured thereto.

Embodiments of the present invention provide a corrugated paperboard signage assembly 10 that is capable of being initially provided in a two-dimensional knockdown configuration, such as illustrated in FIGS. 1-2. From the knockdown configuration, the signage assembly 10 is capable of being erected into a three-dimensional configuration, such as illustrated in FIG. 5. Returning to FIG. 1, the signage assembly of embodiments of the present invention comprises a rectangular backer panel 12; a former panel 14 secured to the backer panel; and a front graphic panel 16 secured to the backer panel and/or former panel. In certain embodiments, each of the back panel 12, former panel 14, and graphic panel 16 are formed from corrugated material. In certain embodiments, such corrugated material includes paperboard. However, other embodiments provide for the corrugated material to include other similar type materials, such as cardboard, fiberboard, or the like.

Turning to FIG. 2, in certain embodiments, the backer panel 12 and the former panel 14 are secured together with an adhesive, such as glue, tape, or other adhesive-like material. Nevertheless, it will be appreciated that other embodiments utilize other means of joining now known or hereinafter developed, including but not necessarily limited to various styles of fasteners, such as staples, rivets, hooks, pins, and the like.

In certain embodiments, the former panel 14 includes a central section 20 opposed by lateral sections 22, with the central section of the former panel being secured to the backer panel 12. In the embodiment shown, the central section 20 includes a longitudinal axis (not shown) of the former panel 14, such that when the former panel is secured to the backer panel 12, the longitudinal axis of the former panel is parallel with or aligned with a longitudinal axis (not shown) of the backer panel. As previously mentioned, the backer panel 12 is generally a rectangular piece of corrugated material. In certain embodiments, ends of the backer panel 12 include slots, notches, or other similar type openings (not shown) formed thereon. As will be described in more detail below, such openings are used to secure the front graphic panel 16 to the backer panel 12.

In embodiments of the present invention, the former panel 14 includes a pair of pre-cut support members 24 that are operable to be folded away from the central section 20 of the former panel. In certain embodiments, the support members 24 are operable to fold along pre-folded, pre-weakened or perforated fold lines 26 connecting the support members to the former panel 14. For example, in some embodiments, the fold lines 26 are formed by compressing along a thin line or a segment of the material comprising the former panel, so as to define the fold line. In certain embodiments, each of the support members 24 includes two tabs 28 that extend laterally from the support members. Additionally, the former panel 14 includes two slots 30 on each of the lateral sections 22, with the slots positioned adjacent to the support members 24. Furthermore, in certain embodiments the lateral sections 22 of the former panel 14 are operable to fold away from the central section 20 of the former panel. As with the support members, certain embodiments provide for the lateral sections 22 to fold about pre-folded, pre-weakened or perforated fold lines 32 that connect the lateral sections to the central section 20 of the former panel 14.

Figure 3:
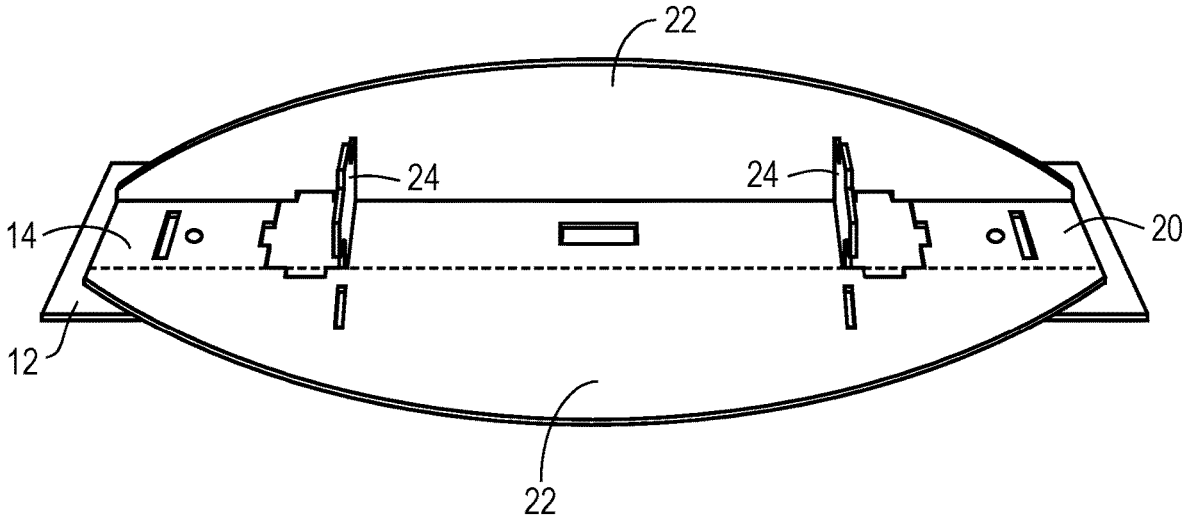
FIG. 3 is a perspective view of the former panel and the backer panel from FIGS. 1-2, with the former panel being partially erected in an erected configuration.
Figure 4:
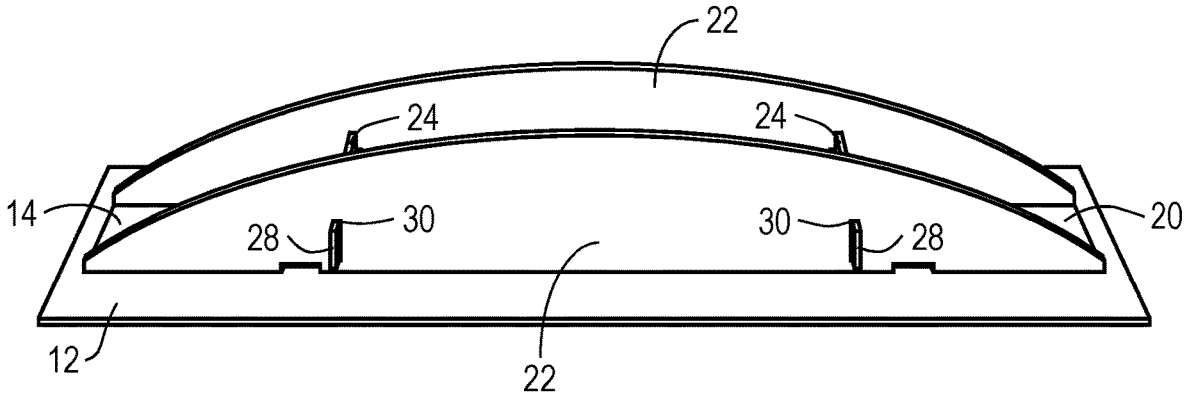
FIG. 4 is a perspective view of the former panel and the backer panel from FIGS. 1-3, with the former panel being fully erected in an erected configuration.

In operation, the signage assembly 10 of the embodiments shown is capable of being transformed in a quick and efficient manner from the knockdown configuration of FIG. 2, to the erected configuration of FIG. 5. To begin, and as illustrated by FIG. 3, the support members 24 of the former panel 14 are folded away from the central section 20 of the former panel until such support members are generally orthogonal to the central section and the backer panel 12. Next, the lateral sections 22 are folded away from the central section 20 until the lateral sections are generally orthogonal to the central section and the backer panel 12. FIG. 3 illustrates a single lateral section 22 folded away from the central section 20, and FIG. 4 illustrates both laterals sections folded away from the central section. As such, and as illustrated by FIG. 4, the slots 30 in the lateral sections 22 mate with the tabs 28 of the support members 24 to provide a rigid and a three dimensional support for the front graphic panel 16.

In the embodiments shown, the front graphic panel 16 is secured to the former panel 14 and/or the backer panel 12 by being wrapped around the lateral sections 22 of the former panel, such as illustrated in FIG. 5. In certain embodiments the front graphic panel 16 is secured to the former panel 14 and/or the backer panel 12 by glue or other adhesive. In other embodiments, the front graphic panel 16 has ends that mate with the openings on the ends of the backer panel 12. For instance, certain embodiments provide for the front graphic panel 16 to have end tabs (not shown) configured to mate with the openings (not shown) at the ends of the backer panel 12 to secure the graphic panel in position. In other embodiments, the ends of the front graphic panel 16 are secured to the ends of the backer panel by other means of securement, such as by hook and loop fastener material, button-hook fasteners, or the like. Thus, as illustrated by FIG. 5, the signage assembly 10 is capable of being erected in the erected configuration that provides for the front graphic display 16 to be presented in a three-dimensional form.

Figure 6:
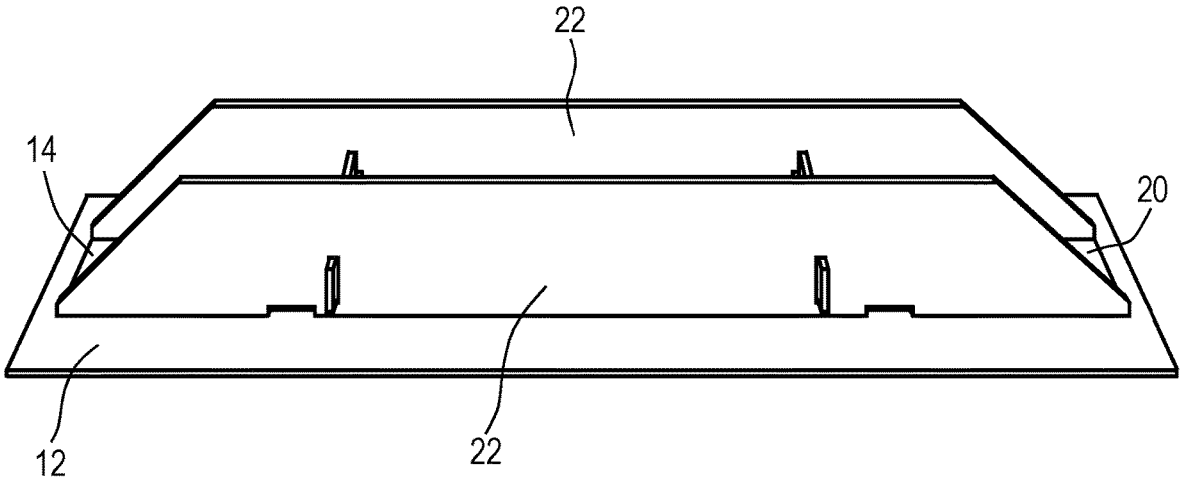
FIG. 6 is an perspective view of a former panel with a segmented shape secured to a backer panel according to embodiments of the present invention.
Figure 7:
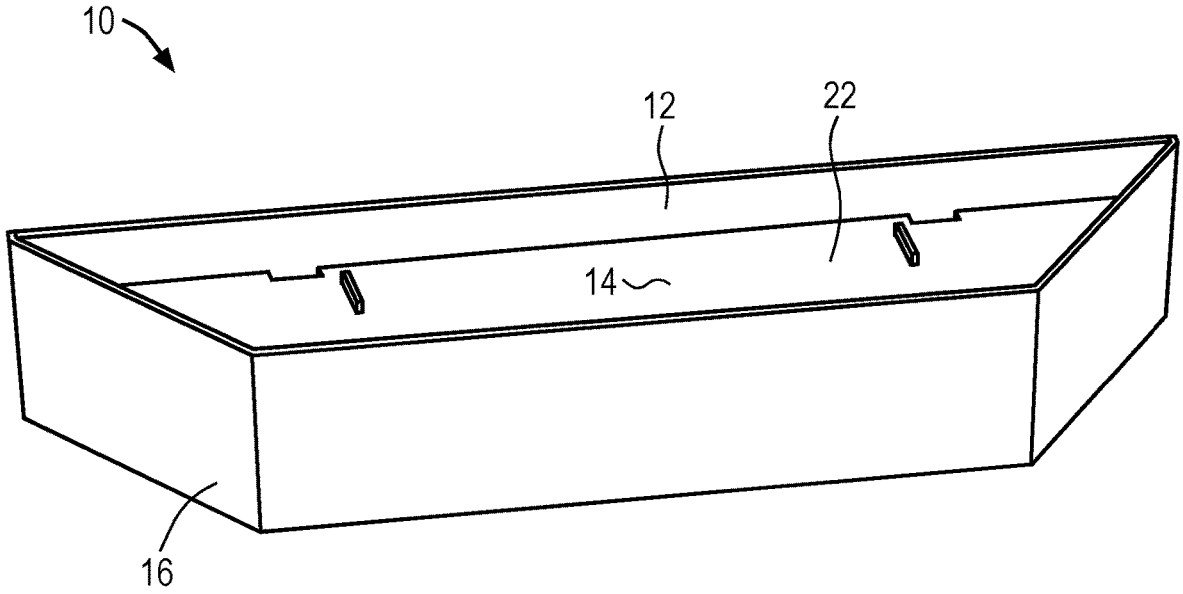
FIG. 7 is a perspective view of the former panel and the backer panel from FIG. 6, with a front graphic panel secured thereto.

In certain embodiments, the front graphic panel 16 is a generally rectangular piece of corrugated material that is sized to fit around the lateral sections 22 of the former panel 14. However, it will be appreciated that the size and shape of the front graphic panel 16 of the will vary in other embodiments without departing from the spirit and scope of the present invention. Furthermore, once the front graphic panel 16 is secured to the former panel 14 and/or the backer panel 12, the presented shape of the front graphic panel is dependent on a shape of exterior edges of the lateral sections. For instance, in embodiments such as shown in FIGS. 1-5, the exterior edges of the lateral sections 22 of the former panel 14 are arcuate in shape, such that when the front graphic panel 16 is wrapped around the lateral sections, the graphic panel is presented in an arcuate three-dimensional configuration (e.g., FIG. 5). Alternatively, as illustrated in FIG. 6-7, embodiments of the present invention include the lateral sections 22 formed with external edges that have one or more linear segments, such that when the front graphic panel 16 is wrapped around the former panel 14, the font graphic panel forms a segmented three-dimensional configuration (e.g., FIG. 7). However, it is understood that embodiments of the present invention include a plurality of types of shapes for the lateral sections 22 of the former panel 14, such that the front graphic panel 16 includes similar corresponding forms and presents a corresponding plurality of three-dimensional shapes.

Although the invention has been described with reference to the embodiments illustrated in the attached drawing figures, it is noted that equivalents may be employed and substitutions made herein without departing from the scope of the invention as recited in the claims.

What is claimed is:

1. A corrugated display sign comprising:

a former panel, said former panel comprising:

opposed first and second lateral sections having opposed inner and outer edges, respectively, said first lateral section being movable between a stowed configuration and a deployed configuration; and a first support member having a proximal end extending at least partially between respective inner edges of said first and second lateral sections, said first support member being movable between a stowed configuration and a deployed configuration, the stowed and deployed configurations of said first support member being associated with respective stowed and deployed configurations of said first lateral section, wherein said first support member comprises a first tab member displaced from said proximal end of said first support member; and a graphic panel operable to be wrapped about an exterior edge of said first lateral section when said first lateral section is in the deployed configuration such that said graphic panel is generally perpendicular to said first lateral section.

2. The corrugated display sign of claim 1, wherein said display sign is formed from corrugated paperboard material.

3. The corrugated display sign of claim 1, wherein said first support member is configured to be moved between the stowed and deployed configurations by being folded about said proximal end of said first support member.

4. The corrugated display sign of claim 1, wherein said first lateral section is configured to be moved between the stowed and deployed configurations by being folded about said inner edge of said first lateral section.

5. The corrugated display sign of claim 4, wherein said first support member is configured to be moved between the stowed and deployed configurations by being folded about said proximal end of said first support member.

6. The corrugated display sign of claim 5, wherein said first lateral section comprises an inner surface extending between said inner and outer edges, wherein said first support member comprises a first edge extending at least partially between said first tab member and at least one of said proximal end of said first support member and a distal end of said first support member, and wherein said inner surface of said first lateral section abuts at least a portion of said first edge of said first support member when said first lateral section and said first support member are in their respective deployed configurations.

7. The corrugated display sign of claim 6, wherein said first tab member of said first support member is mated with a first preformed slot of said first lateral section when said first lateral section and said first support member are in their respective deployed configurations.

8. The corrugated display sign of claim 7, wherein said former panel further comprises a second support member having a proximal end extending at least partially between respective inner edges of said first and second lateral sections, wherein:

said second support member is displaced from said first support member;

said second support member is movable between a stowed configuration and a deployed configuration, said stowed and deployed configurations of said second support member being associated with respective stowed and deployed configurations of said first lateral section;

said second support member comprises a first tab member displaced from said proximal end of said second support member; and said first tab member of said second support member is mated with a second preformed slot of said first lateral section when said first lateral section and said second support member are in their respective deployed configurations.

9. The corrugated display sign of claim 1, wherein:

said graphic panel is operable to be wrapped about said exterior edges of said first and second lateral sections; and said exterior edges of said first and second lateral sections have an arcuate shape, such that said graphic panel being wrapped about said exterior edges of said first and second lateral sections has a corresponding arcuate shape.

10. The corrugated display sign of claim 1, wherein:

said graphic panel is operable to be wrapped about said exterior edges of said first and second lateral sections; and said exterior edges of said first and second lateral sections have a linear segmented shape, such that said graphic panel being wrapped about said exterior edges of said first and second lateral sections has a corresponding linear segmented shape.

11. A method of making a corrugated display sign, comprising:

cutting outer edges of opposed first and second lateral sections to form a former panel, the first lateral section being moveable between a stowed configuration and a deployed configuration;

cutting the former panel to present a first support member, the first support member having a proximal end extending at least partially between respective inner edges of the first and second lateral sections such that the first support member is movable between a stowed configuration and a deployed configuration, the stowed and deployed configurations of the first support member being associated with respective stowed and deployed configurations of the first lateral section; and forming a graphic panel, the graphic panel being configured to wrap about the exterior edges of the first lateral section when the first lateral section is in the deployed configuration such that the graphic panel is generally perpendicular to the first lateral section, and wherein the first support member comprises a first tab member displaced from the proximal end of the first support member.

12. The method of claim 11, wherein the first lateral section comprises an inner surface extending between the inner and outer edges, wherein the first support member comprises a first edge extending at least partially between the first tab member and at least one of the proximal end of the first support member and a distal end of the first support member, and wherein the inner surface of the first lateral section abuts at least a portion of the first edge of the first support member when the first lateral section and the first support member are in their respective deployed configurations.

13. The method of claim 11, further comprising forming a first slot in the first lateral section, the first slot being configured to receive the first tab member of the first support member when the first lateral section and the first support member are in their respective deployed configurations.

14. A method of erecting a corrugated display sign, comprising:

providing the display sign in a knockdown configuration, wherein the display sign—comprises:

a former panel, the former panel including:

opposed first and second lateral sections having inner and outer edges, respectively; and a first support member having a proximal end extending at least partially between respective inner edges of the first and second lateral sections, wherein the first lateral section is moveable between a stowed configuration and a deployed configuration, wherein the first support member comprises a first tab member displaced from the proximal end of the first support member, and wherein the first support member is movable between a stowed configuration and a deployed configuration, the stowed and deployed configurations of the first support member being associated with respective stowed and deployed configurations of the first lateral section;

folding the first support member to the deployed configuration;

folding the first lateral section until the first lateral section abuts the first support member, while the first support member remains in the deployed configuration, thereby moving the first lateral section to its respective deployed configuration; and wrapping a graphic panel about exterior edges of the first and second lateral sections while the first lateral section remains in its deployed configuration such that the graphic panel is generally perpendicular to the first lateral section.

15. The method of claim 14, wherein the display sign is formed from corrugated paperboard material.

16. The method of claim 14, wherein the first lateral section comprises an inner surface extending between the inner and outer edges, wherein the first support member comprises a first edge extending at least partially between the first tab member and at least one of the proximal end of the first support member and a distal end of the first support member, and wherein the inner surface of the first lateral section abuts at least a portion of the first edge of the first support member when the first lateral section and the first support member are in their respective deployed configurations.

17. The method of claim 16, further comprising:

mating the first tab member of the first support member with a preformed slot of the first lateral section.

18. The method of claim 14, further comprising mating the first tab member of the first support member with a preformed slot of the first lateral section.

19. The corrugated display sign of claim 14, further comprising:

wrapping the graphic panel about the exterior edges, such that the graphic panel presents an arcuate shape.

20. The corrugated display sign of claim 14, further comprising:

wrapping the graphic panel about the exterior edges, such that the graphic panel presents a linear segmented shape.

* * * * *